US009822622B2

(12) United States Patent
Trautman et al.

(10) Patent No.: US 9,822,622 B2
(45) **Date of Patent: *Nov. 21, 2017**

(54) HYDROCARBON RESOURCE HEATING SYSTEM INCLUDING CHOKE FLUID DISPENSERS AND RELATED METHODS

(71) Applicant: Harris Corporation, Melbourne, FL (US)

(72) Inventors: Mark Trautman, Melbourne, FL (US); Verlin Hibner, Melbourne Beach, FL (US); Murray Hann, Malabar, FL (US); Brian Wright, Indialantic, FL (US)

(73) Assignee: HARRIS CORPORATION, Melbourne, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/383,057

(22) Filed: Dec. 19, 2016

(65) Prior Publication Data

US 2017/0114623 A1 Apr. 27, 2017

Related U.S. Application Data

(63) Continuation-in-part of application No. 14/560,039, filed on Dec. 4, 2014.

(51) Int. Cl.

| | |
|---|---|
| ***E21B 43/24*** | (2006.01) |
| ***E21B 34/06*** | (2006.01) |
| *E21B 34/00* | (2006.01) |

(52) U.S. Cl.

CPC ..... *E21B 43/2401* (2013.01); *E21B 34/06* (2013.01); *E21B 2034/007* (2013.01)

(58) Field of Classification Search

CPC ..... E21B 43/2401; E21B 36/00; E21B 36/04; E21B 34/12

See application file for complete search history.

(56) References Cited

U.S. PATENT DOCUMENTS

| | | | |
|---|---|---|---|
| 5,065,819 | A | 11/1991 | Kasevich |
| 7,441,597 | B2 | 10/2008 | Kasevich |
| 7,891,421 | B2 | 2/2011 | Kasevich |
| 9,328,593 | B2 | 5/2016 | Wright |
| 9,404,352 | B2 | 8/2016 | Dittmer et al. |
| 9,441,472 | B2 | 9/2016 | Wright et al. |

(Continued)

*Primary Examiner* — Robert E Fuller
*Assistant Examiner* — David Carroll
(74) *Attorney, Agent, or Firm* — Allen, Dyer, Doppelt, Gilchrist, P.A. Attorneys at Law

(57) ABSTRACT

A system for heating a hydrocarbon resource in a subterranean formation having a wellbore extending therein may include a radio frequency (RF) source, a choke fluid source, and an elongate RF antenna configured to be positioned within the wellbore and coupled to the RF source. The elongate RF antenna may have a proximal end and a distal end separated from the proximal end. The system may further include a first choke fluid dispenser coupled to the choke fluid source and positioned to selectively dispense choke fluid into adjacent portions of the subterranean formation at the proximal end of the RF antenna, and a second choke fluid dispenser coupled to the choke fluid source and positioned to selectively dispense choke fluid into adjacent portions of the subterranean formation at the distal end of the RF antenna.

20 Claims, 7 Drawing Sheets

(56) References Cited

U.S. PATENT DOCUMENTS

| | | | | |
|---|---|---|---|---|
| 2010/0078163 | A1 | 4/2010 | Banerjee et al. | |
| 2010/0294488 | A1 | 11/2010 | Wheeler et al. | |
| 2010/0294489 | A1 | 11/2010 | Dreher, Jr. et al. | |
| 2012/0067580 | A1* | 3/2012 | Parsche ..... | E21B 43/2401 166/302 |
| 2013/0334205 | A1 | 12/2013 | Wright et al. | |
| 2014/0216714 | A1 | 8/2014 | Dittmer et al. | |
| 2014/0216726 | A1* | 8/2014 | Dittmer ..... | E21B 43/2401 166/248 |
| 2016/0160622 | A1 | 6/2016 | Trautman et al. | |
| 2016/0160623 | A1 | 6/2016 | White et al. | |

* cited by examiner

65
INCREASING TIME

HYDROCARBON RESOURCE HEATING SYSTEM INCLUDING CHOKE FLUID DISPENSERS AND RELATED METHODS

RELATED APPLICATIONS

This application is a continuation-in-part of application Ser. No. 14/560,039 filed Dec. 4, 2014, which is hereby incorporated herein in its entirety by reference.

TECHNICAL FIELD

The present invention relates to the field of hydrocarbon resource recovery, and, more particularly, to hydrocarbon resource recovery using RF heating.

BACKGROUND

Energy consumption worldwide is generally increasing, and conventional hydrocarbon resources are being consumed. In an attempt to meet demand, the exploitation of unconventional resources may be desired. For example, highly viscous hydrocarbon resources, such as heavy oils, may be trapped in tar sands where their viscous nature does not permit conventional oil well production. Estimates are that trillions of barrels of oil reserves may be found in such tar sand formations.

In some instances these tar sand deposits are currently extracted via open-pit mining. Another approach for in situ extraction for deeper deposits is known as Steam-Assisted Gravity Drainage (SAGD). The heavy oil is immobile at reservoir temperatures and therefore the oil is typically heated to reduce its viscosity and mobilize the oil flow. In SAGD, pairs of injector and producer wells are formed to be laterally extending in the ground. Each pair of injector/producer wells includes a lower producer well and an upper injector well. The injector/production wells are typically located in the pay zone of the subterranean formation between an underburden layer and an overburden layer.

The upper injector well is used to typically inject steam, and the lower producer well collects the heated crude oil or bitumen that flows out of the formation, along with any water from the condensation of injected steam. The injected steam forms a steam chamber that expands vertically and horizontally in the formation. The heat from the steam reduces the viscosity of the heavy crude oil or bitumen which allows it to flow down into the lower producer well where it is collected and recovered. The steam and gases rise due to their lower density so that steam is not produced at the lower producer well and steam trap control is used to the same effect. Gases, such as methane, carbon dioxide, and hydrogen sulfide, for example, may tend to rise in the steam chamber and fill the void space left by the oil defining an insulating layer above the steam. Oil and water flow is by gravity driven drainage, into the lower producer well.

Operating the injection and production wells at approximately reservoir pressure may address the instability problems that adversely affect high-pressure steam processes. SAGD may produce a smooth, even production that can be as high as 70% to 80% of the original oil in place (OOIP) in suitable reservoirs. The SAGD process may be relatively sensitive to shale streaks and other vertical barriers since, as the rock is heated, differential thermal expansion causes fractures in it, allowing steam and fluids to flow through. SAGD may be twice as efficient as the older cyclic steam stimulation (CSS) process.

Many countries in the world have large deposits of oil sands, including the United States, Russia, and various countries in the Middle East. Oil sands may represent as much as two-thirds of the world's total petroleum resource, with at least 1.7 trillion barrels in the Canadian Athabasca Oil Sands, for example. At the present time, only Canada has a large-scale commercial oil sands industry, though a small amount of oil from oil sands is also produced in Venezuela. Because of increasing oil sands production, Canada has become the largest single supplier of oil and products to the United States. Oil sands now are the source of almost half of Canada's oil production, although due to the 2008 economic downturn work on new projects has been deferred, while Venezuelan production has been declining in recent years. Oil is not yet produced from oil sands on a significant level in other countries.

U.S. Published Patent Application No. 2010/0078163 to Banerjee et al. discloses a hydrocarbon recovery process whereby three wells are provided, namely an uppermost well used to inject water, a middle well used to introduce microwaves into the reservoir, and a lowermost well for production. A microwave generator generates microwaves which are directed into a zone above the middle well through a series of waveguides. The frequency of the microwaves is at a frequency substantially equivalent to the resonant frequency of the water so that the water is heated.

Along these lines, U.S. Published Application No. 2010/0294489 to Dreher, Jr. et al. discloses using microwaves to provide heating. An activator is injected below the surface and is heated by the microwaves, and the activator then heats the heavy oil in the production well. U.S. Published Application No. 2010/0294488 to Wheeler et al. discloses a similar approach.

U.S. Pat. No. 7,441,597 to Kasevich discloses using a radio frequency generator to apply RF energy to a horizontal portion of an RF well positioned above a horizontal portion of an oil/gas producing well. The viscosity of the oil is reduced as a result of the RF energy, which causes the oil to drain due to gravity. The oil is recovered through the oil/gas producing well.

Unfortunately, long production times, for example, due to a failed start-up, to extract oil using SAGD may lead to significant heat loss to the adjacent soil, excessive consumption of steam, and a high cost for recovery. Significant water resources are also typically used to recover oil using SAGD, which impacts the environment. Limited water resources may also limit oil recovery. SAGD is also not an available process in permafrost regions, for example.

Despite the existence of systems that utilize RF energy to provide heating, such systems suffer from the inevitable high degree of electrical near field coupling that exists between the radiating antenna element and the transmission line system that delivers the RF power to the antenna, resulting in common mode current on the outside of the transmission line. Left unchecked, this common mode current heats unwanted areas of the formation, effectively making the transmission line part of the radiating antenna. One system which may be used to help overcome this problem is disclosed in U.S. Pat. No. 9,441,472, which is also assigned to the present Applicant and is hereby incorporated herein in its entirety by reference. This reference discloses a system for heating a hydrocarbon resource in a subterranean formation having a wellbore extending therein which includes a radio frequency (RF) antenna configured to be positioned within the wellbore, an RF source, a cooling fluid source, and a transmission line coupled between the RF antenna and the RF source. A plurality of ring-shaped choke cores may surround the transmission line, and a sleeve may surround the ring-shaped choke cores and define a cooling fluid path for the ring-shaped choke cores in fluid communication with the cooling fluid source.

Despite the advantages of such systems, further approaches to common mode current mitigation may be desirable in some circumstances.

SUMMARY

A system for heating a hydrocarbon resource in a subterranean formation having a wellbore extending therein may include a radio frequency (RF) source, a choke fluid source, and an elongate RF antenna configured to be positioned within the wellbore and coupled to the RF source. The elongate RF antenna may have a proximal end and a distal end separated from the proximal end. The system may further include a first choke fluid dispenser coupled to the choke fluid source and positioned to selectively dispense choke fluid into adjacent portions of the subterranean formation at the proximal end of the RF antenna, and a second choke fluid dispenser coupled to the choke fluid source and positioned to selectively dispense choke fluid into adjacent portions of the subterranean formation at the distal end of the RF antenna.

More particularly, the RF antenna may include a proximal cylindrical conductor, and the system may also include an RF transmission line extending at least partially within the proximal cylindrical conductor and coupling the RF source to the RF antenna. The first choke fluid dispenser may be carried by the transmission line and include an inner sleeve surrounding the RF transmission line, a liner surrounding the inner sleeve and defining a first annular chamber therewith, where the liner may have a plurality of ports therein in fluid communication with the choke fluid source, and an outer sleeve surrounding the liner and defining a second annular chamber therewith to receive choke fluid from the plurality of ports. The outer sleeve may have a plurality of openings therein to pass choke fluid from the annular chamber into the subterranean formation adjacent the proximal end of the antenna. Moreover, the inner sleeve may be slidably moveable with respect to the liner, and the liner may be fixed to the outer sleeve.

In addition, the RF antenna may further include a center isolator coupled to the proximal cylindrical conductor and a distal cylindrical conductor coupled to the center isolator opposite the proximal cylindrical conductor. Furthermore, the second choke fluid dispenser may be carried by the distal cylindrical conductor and include an inner sleeve, and a liner surrounding the inner sleeve and defining a first annular chamber therewith. The liner may have a plurality of ports therein in fluid communication with the choke fluid source. Additionally, an outer sleeve may surround the liner and define a second annular chamber therewith to receive choke fluid from the plurality of ports. The outer sleeve may have a plurality of openings therein to pass choke fluid from the annular chamber into the subterranean formation adjacent the distal end of the RF antenna.

The first and second choke fluid dispensers may each further include a respective seal at each opposing end. The RF antenna may include a proximal cylindrical conductor having a plurality of collection openings therein to collect hydrocarbon resources from adjacent portions of the subterranean formation, and the first choke fluid dispenser may be positioned in spaced relation from the collection openings. By way of example, the choke fluid may comprise an electrical conductivity enhancing fluid, such as water.

A method for heating a hydrocarbon resource in a subterranean formation having a wellbore extending therein may include applying RF power to an elongate RF antenna positioned within the wellbore using an RF source, where the elongate RF antenna has a proximal end and a distal end separated from the proximal end. The method may further include selectively dispensing a choke fluid from a choke fluid source into adjacent portions of the subterranean formation at the proximal end of the RF antenna via a first choke fluid dispenser positioned in the wellbore at the proximal end of the RF antenna. The method may also include selectively dispensing choke fluid from the choke fluid source into adjacent portions of the subterranean formation at the distal end of the RF antenna via a second choke fluid dispenser positioned in the wellbore at the distal end of the RF antenna.

DETAILED DESCRIPTION OF THE EMBODIMENTS

The present description is made with reference to the accompanying drawings, in which exemplary embodiments are shown. However, many different embodiments may be used, and thus the description should not be construed as limited to the particular embodiments set forth herein. Rather, these embodiments are provided so that this disclosure will be thorough and complete. Like numbers refer to like elements throughout, and prime notation is used to indicate similar elements in different embodiments.

Figure 1:
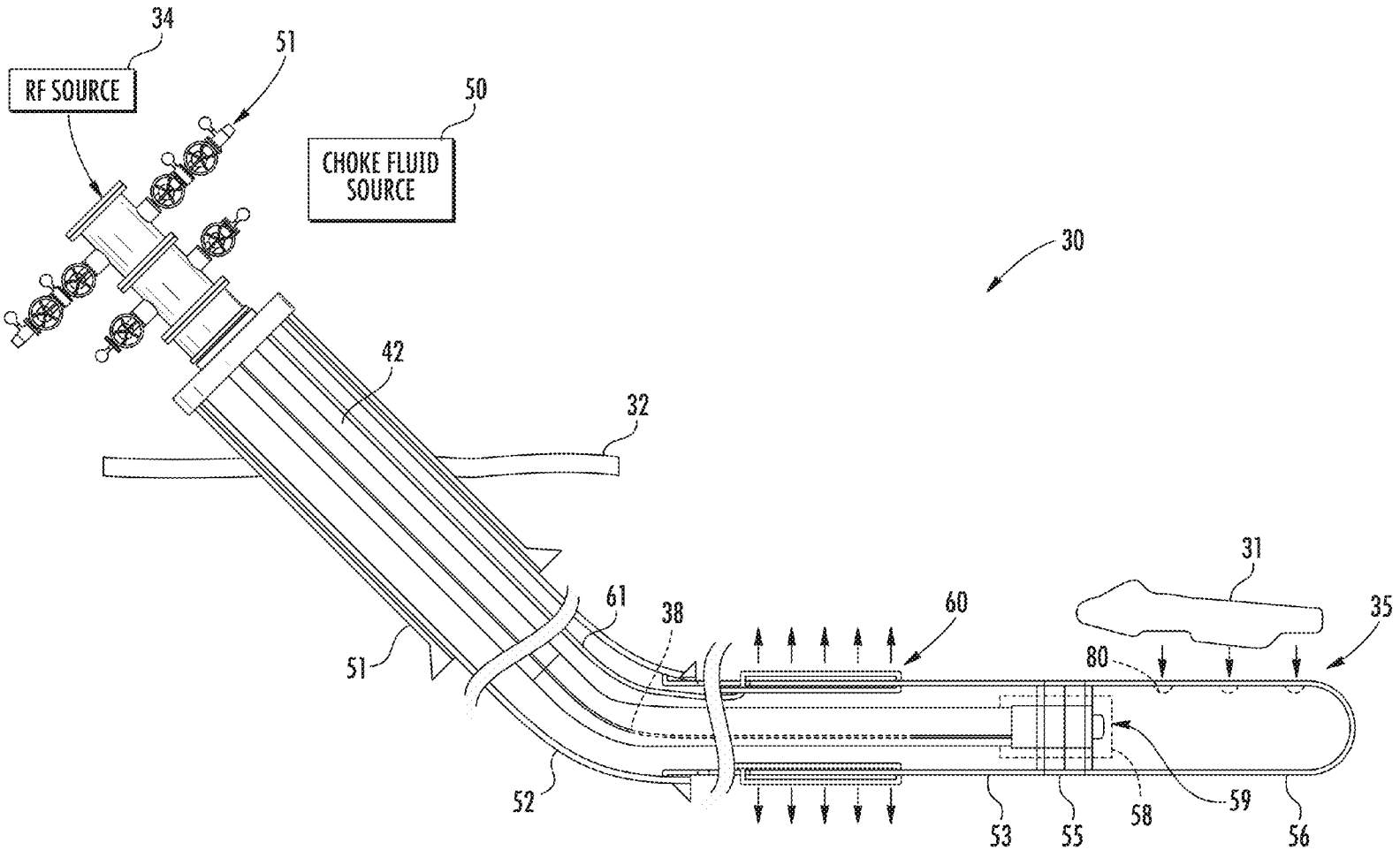
FIG. 1 is a schematic diagram, partially in section, of a system for heating a hydrocarbon resource in accordance with an example embodiment including a choke fluid dispenser.

Referring initially to FIG. 1, a system 30 for heating a hydrocarbon resource 31 (e.g., oil sands, etc.) in a subterranean formation 32 having a wellbore therein is first described. In the illustrated example, the wellbore is a laterally extending wellbore, although the system 30 may be used with vertical or other wellbores in different configurations. The system 30 further includes a radio frequency (RF)

source 34 for an RF antenna or transducer 35 that is positioned in the wellbore adjacent the hydrocarbon resource 31. The RF source 34 is illustratively positioned above the subterranean formation 32, and may be an RF power generator, for example. In an exemplary implementation, the laterally extending wellbore may extend several hundred meters (or more) within the subterranean formation 32. Moreover, a typical laterally extending wellbore may have a diameter of about fourteen inches or less, although larger wellbores may be used in some implementations. Although not shown, in some embodiments a second or producing wellbore may be used below the wellbore, such as would be found in a SAGD implementation, for collection of petroleum, bitumen, etc., released from the subterranean formation 32 through heating.

Figure 7:
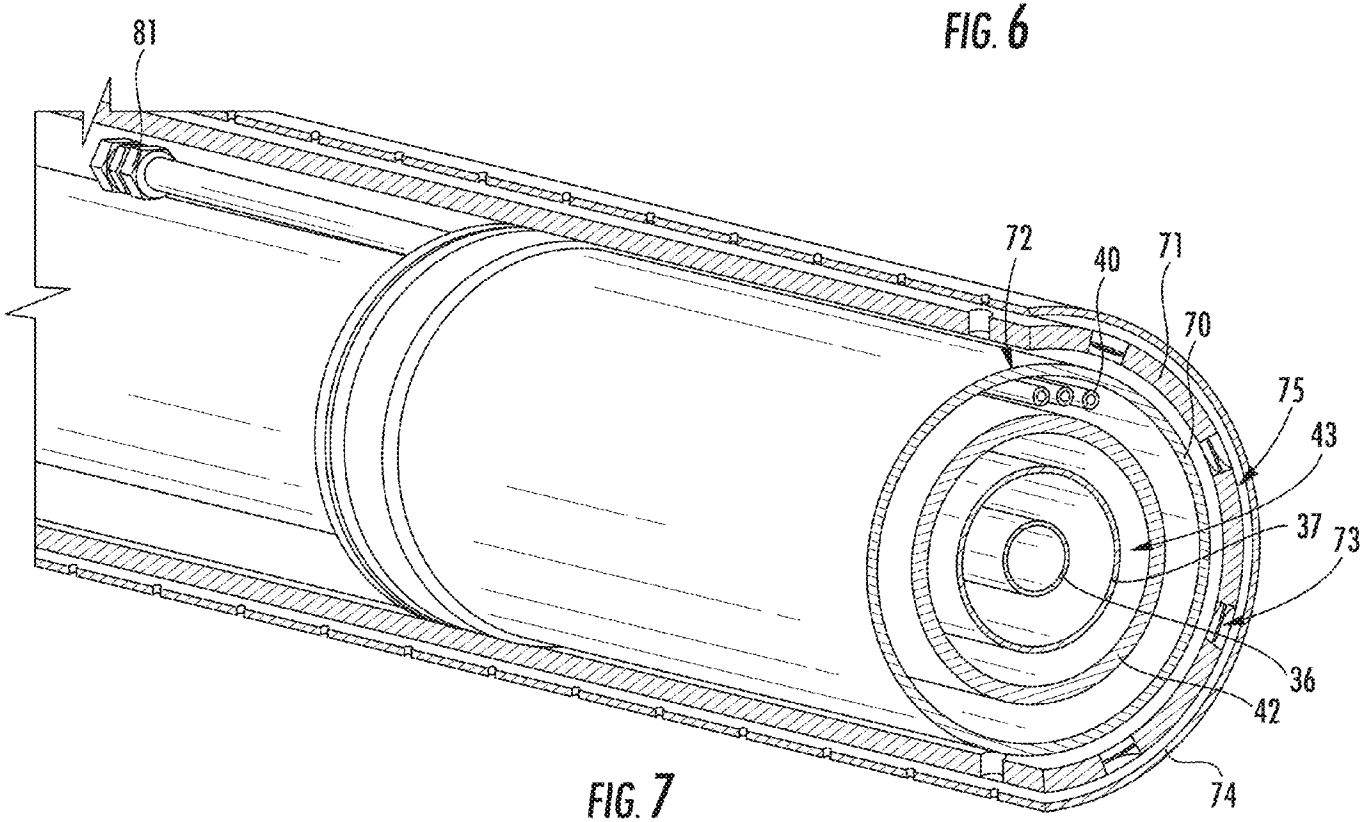
FIG. 7 is a perspective sectional view of the choke fluid dispenser and RF transmission line of the system of FIG. 1 illustrating the various components and annuli therein.

Referring additionally to FIG. 7, a coaxial transmission line 38 extends within the wellbore 33 between the RF source 34 and the RF antenna 35. The transmission line 38 includes an inner conductor 36 and an outer conductor 37. In some embodiments, one or more radial support members (not shown) may be positioned between the inner and outer conductors. The radial support members may have openings therein which may be used to route tubes 40 for fluid, gas flow, etc. For example, the space between the inner conductor 36 and the outer conductor 37 may be filled with an insulating gas, such as nitrogen, if desired. Moreover, the tubes 40 may also be used to deliver fluids such as a solvent to be dispensed in the pay zone where the hydrocarbon resource 31 is located, for example.

A drill tubular 42 (e.g., a metal pipe) surrounds the outer conductor 37 and may be supported by spacers (not shown). A space between the outer conductor 37 and the drill tubular 42 defines a passageway 43 which may be used for returning reservoir fluid (e.g., bitumen) back to the surface, for example, to a well head 51, if desired. In such a configuration, proximal and/or distal slotted liner portions 53, 56 of the antenna 35 would include a plurality of collection openings 80 therein to collect hydrocarbon resources 31 from adjacent portions of the subterranean formation 32, and the choke fluid dispenser 60 may be positioned in spaced relation (i.e., up hole) from the collection openings as shown, such as adjacent the heel of the antenna 35.

However, it should be noted that the illustrated configuration need not be used for production in all embodiments, and that the passageway 43 could be used for other purposes, such as to supply other fluids (e.g., cooling fluid, etc.), or remain unused. Further details regarding exemplary transmission line 38 support and interconnect structures which may be used in the configurations provided herein may be found in U.S. Published Application No. 2013/0334205, and U.S. Pat. No. 9,404,352 both of which are assigned to the present Applicant and are hereby incorporated herein in their entireties by reference.

A surface casing 51 and an intermediate casing 52 may be positioned within the wellbore as shown. In the illustrated example the RF antenna 35 is coupled with the intermediate casing 52, and the RF antenna illustratively includes a proximal slotted liner portion 53, a center isolator 55 (i.e., a dielectric) coupled to the proximal slotted liner portion, and a distal slotted liner portion 56 coupled to the center isolator opposite the proximal slotted liner portion. The proximal slotted liner portion 53 and distal slotted liner portion 56 are cylindrical conductors (e.g., metal) in the illustrated example, and the RF transmission line 38 extends at least partially within the proximal slotted liner portion and couples the RF source 34 to the RF antenna 35. By way of example, an electromagnetic heating (EMH) tool head 58 may be carried by the drill tubular 42 to plug the transmission line 38 into the antenna 35 when the transmission line is inserted into the wellbore. In the illustrated example, the EMH tool head 58 includes a guide string attachment 59, although other EMH or antenna attachment arrangements may be used in different embodiments.

The RF source 34 may be used to differentially drive the RF antenna 35. That is, the RF antenna 35 may have a balanced design that may be driven from an unbalanced drive signal. Typical frequency range operation for a subterranean heating application may be in a range of about 100 kHz to 10 MHz, and at a power level of several megawatts, for example. However, it will be appreciated that other configurations and operating values may be used in different embodiments. The transmission line 38 and tubular 42 may be implemented as a plurality of separate segments which are successively coupled together and pushed or fed down the wellbore.

The system 30 further illustratively includes a choke fluid dispenser 60 coupled to the transmission line 38 adjacent the RF antenna 35 within the wellbore. The RF antenna 35 may be installed in the well first, followed by the transmission line (and choke assembly 60) which is plugged into the antenna via the EMH tool head 59, thus connecting the transmission line to the antenna. Further details on an exemplary antenna structure which may be used with the embodiments provided herein is set forth in U.S. Pat. No. 9,328,593, which is also assigned to the present Applicant and is hereby incorporated herein in its entirety by reference. However, it should be noted that in some embodiments the RF antenna assembly may be connected to the transmission line at the wellhead and both fed into the wellbore at the same time, as will be appreciated by those skilled in the art.

Generally speaking, the choke fluid dispenser 60 is used for common mode suppression of currents that result from feeding the RF antenna 35. More particularly, the choke fluid dispenser 60 may be used to confine much of the current to the RF antenna 35, rather than allowing it to travel back up the outer conductor 37 of the transmission line, for example, to thereby help maintain volumetric heating in the desired location while enabling efficient, and electromagnetic interference (EMI) compliant operation.

By way of background, because the wellbore diameter is constrained, the radiating antenna 35 and transmission line 38 are typically collinearly arranged. However, this results in significant near field coupling between the antenna 35 and outer conductor 37 of the transmission line 38. This strong coupling manifests itself in current being induced onto the transmission line 38, and if this current is not suppressed, the transmission line effectively becomes an extension of the radiating antenna 35, heating undesired areas of the geological formation 32. The choke fluid dispenser 60, which in the illustrated example is carried on the drill tubular 42, advantageously performs the function of attenuating the induced current on the transmission line 38, effectively confining the radiating current to the antenna 35 proper, where it performs useful heating.

More particularly, a choke fluid that is conductivity enhancing liquid, such as saline or fresh water, is delivered (e.g., in a continuous or repetitive fashion) from the choke fluid source 50 to the choke fluid dispenser 60 via a supply line 61 at the heel or proximal end of the antenna 35 and is allowed to infuse into the reservoir 32. This maintains a relatively high electrical conductivity up hole from the antenna 35 and "pins" the electric field to this location. While the RF heating may steam water at this location in some instances, this may be overcome by the continuing supply of choke fluid which helps block the advance of the RF fields beyond the location of the choke fluid dispenser 60. Considered alternatively, the choke fluid dispenser 60 effectively converts the reservoir 32 into a dissipative broadband choke.

Figure 2:
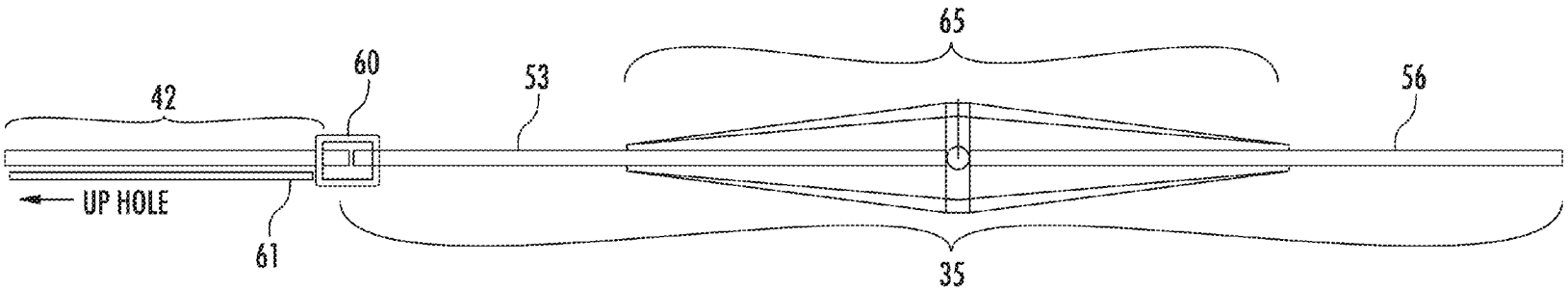
FIG. 2 is a side view of the downhole antenna portion of the system of FIG. 1 illustrating a region of desiccation adjacent the RF antenna.
Figures 3A, 3B, 3C, 3D, 3E, 3F:
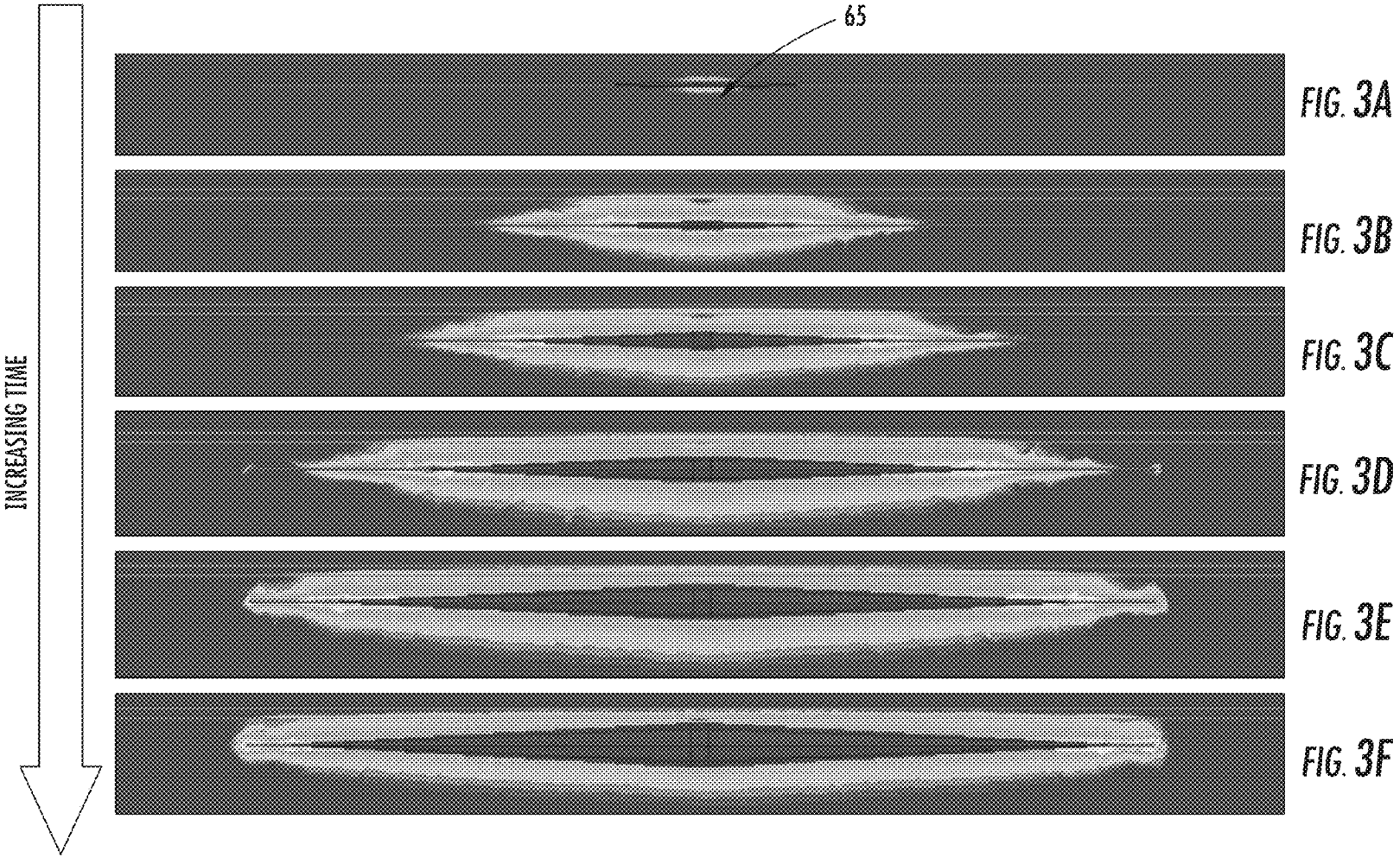
FIGS. 3(*a*)-3(*f*) are a series of time-lapsed simulated cross-sectional views of the desiccation region of FIG. 2 demonstrating changes to the desiccation region over a time period of operation of the RF antenna.

The foregoing will be further understood with reference to FIGS. 2 and 3(*a*)-3(*f*), in which a desiccation region or front 65 forms where the RF heating from the antenna 35 dries or desiccates the formation. The series of time-lapse simulations in FIGS. 3(*a*)-3(*f*) illustrates how this desiccation region 65 grows over the course of operation of the RF antenna 35 over weeks and months. In the illustrated example, the simulation in FIG. 3(*a*) corresponds to the start of the RF heating, while the simulation in FIG. 3(*f*) represents the desiccation region 65 approximately two months later. Power dissipation at the choke fluid dispenser 60 location (here the heel of the antenna 35) is minimal while the tip of the antenna has direct electrical contact with the reservoir (i.e., it is not desiccated and the formation 32 has wet contact with the tip of the antenna). Yet, as operation of the antenna 35 continues and the desiccation region 65 grows over time, this increases the resistivity of the formation 32 adjacent the antenna 35, which causes common mode current to begin to couple to the outer conductor 37 and flow back up the transmission line 38. However, continued use of the choke fluid dispenser 60 over time as the RF antenna 35 is operated advantageously keeps the desiccation region 65 from advancing back up hole past the heel of the antenna 35.

Figures 4A, 4B, 4C:
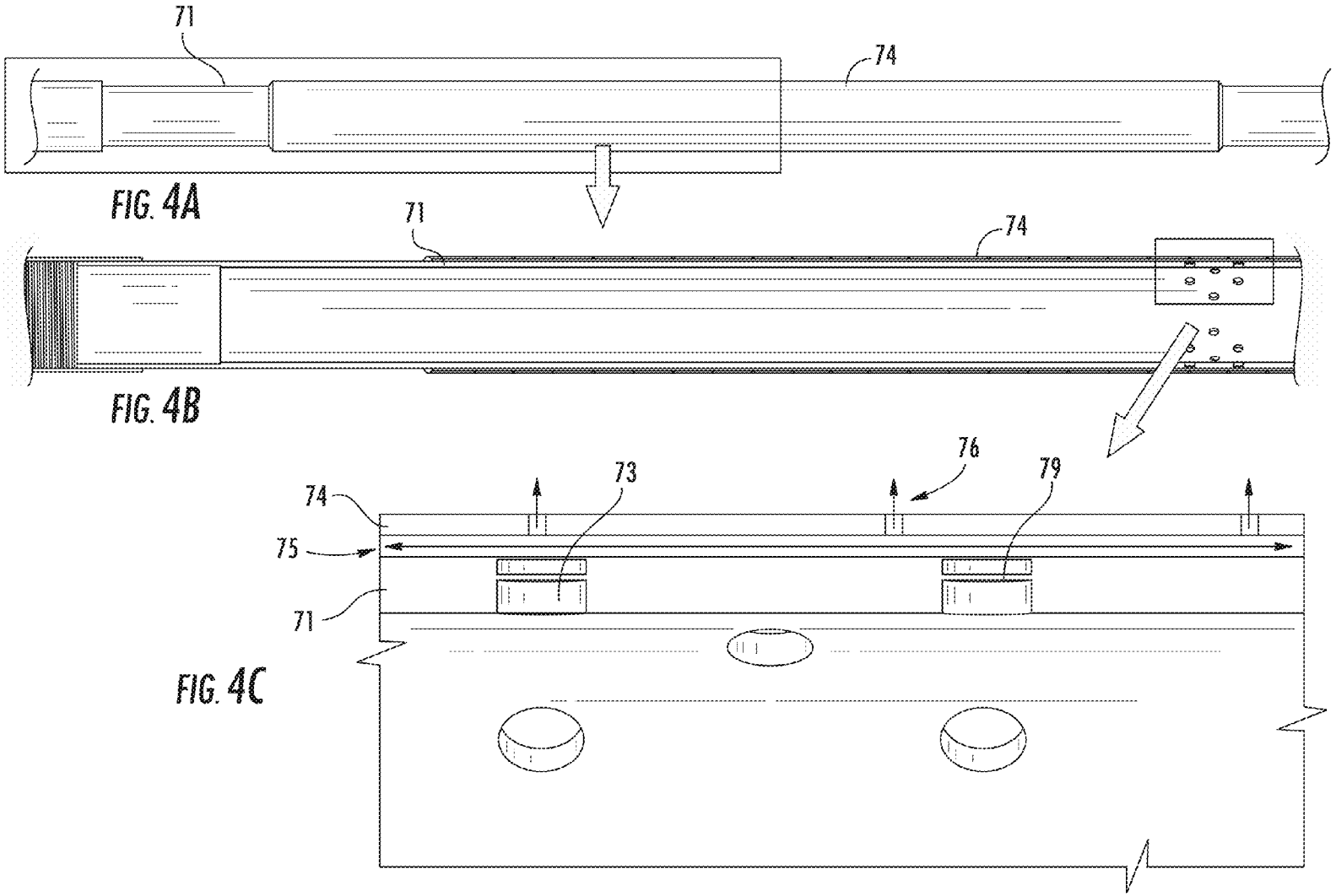
FIGS. 4(*a*)-4(*c*) are side and cross-sectional views of the choke fluid dispenser of the system of FIG. 1 illustrating example choke fluid dispensing portions thereof.

Referring additionally to FIGS. 4(*a*)-7, an example implementation of the choke fluid dispenser 60 is now described. In the illustrated example, the choke fluid dispenser 60 is carried by the drill tubular 42/transmission line 38 assembly and includes an inner sleeve 70 surrounding the drill tubular 42, a liner 71 surrounding the inner sleeve and defining a first annular chamber 72 therewith. The liner 71 has a plurality of ports 73 therein in fluid communication with the choke fluid source 50, as seen in FIG. 4(*c*). Furthermore, an outer sleeve 74 surrounds the liner 71 and defines a second annular chamber 75 therewith to receive choke fluid from the plurality of ports 73. The outer sleeve 71 has a plurality of openings 76 therein (see FIG. 4(*c*)) to pass choke fluid from the annular chamber 75 into the subterranean formation 32 adjacent the antenna 35, as described above. In some embodiments, a sand control screen(s) 79 (e.g., a Facsrite screen) may optionally be used to keep sand from entering the first annular chamber 72, as seen in FIG. 4(*c*). In the illustrated embodiment, the screen 79 is positioned within the ports 73, but they may be located elsewhere in different embodiments. Moreover, other industry standard sand control approaches or configurations may also be used in different embodiments, as will be appreciated by those skilled in the art.

Figure 6:
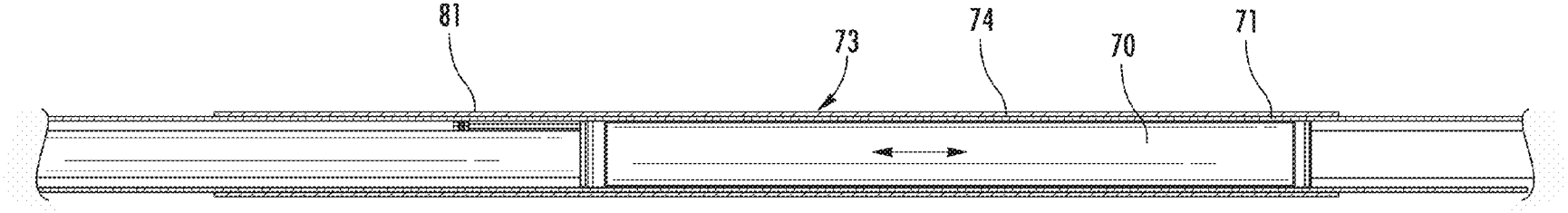
FIG. 6 is a side view, partially in section, of the choke fluid dispenser of the system of FIG. 1 as carried around the transmission line to allow relatively movement to accommodate thermal expansion.

Moreover, to accommodate for thermal expansion, the inner sleeve 70 may be slidably moveable with respect to the liner 71, and the liner may be fixed to the outer sleeve 74, as perhaps best seen in FIG. 6. Thus, as the drill tubular 42/transmission line 38 assembly and liner 70 move along the wellbore based upon thermal expansion (as indicated by the two-headed arrow in FIG. 6), the first annular chamber 72 will always be in alignment with the ports 73, so that the choke fluid will continue to flow into the second annular chamber 75 despite the relative movement of the inner sleeve 70 with respect to the liner 71.

Figures 5A, 5B, 5C:
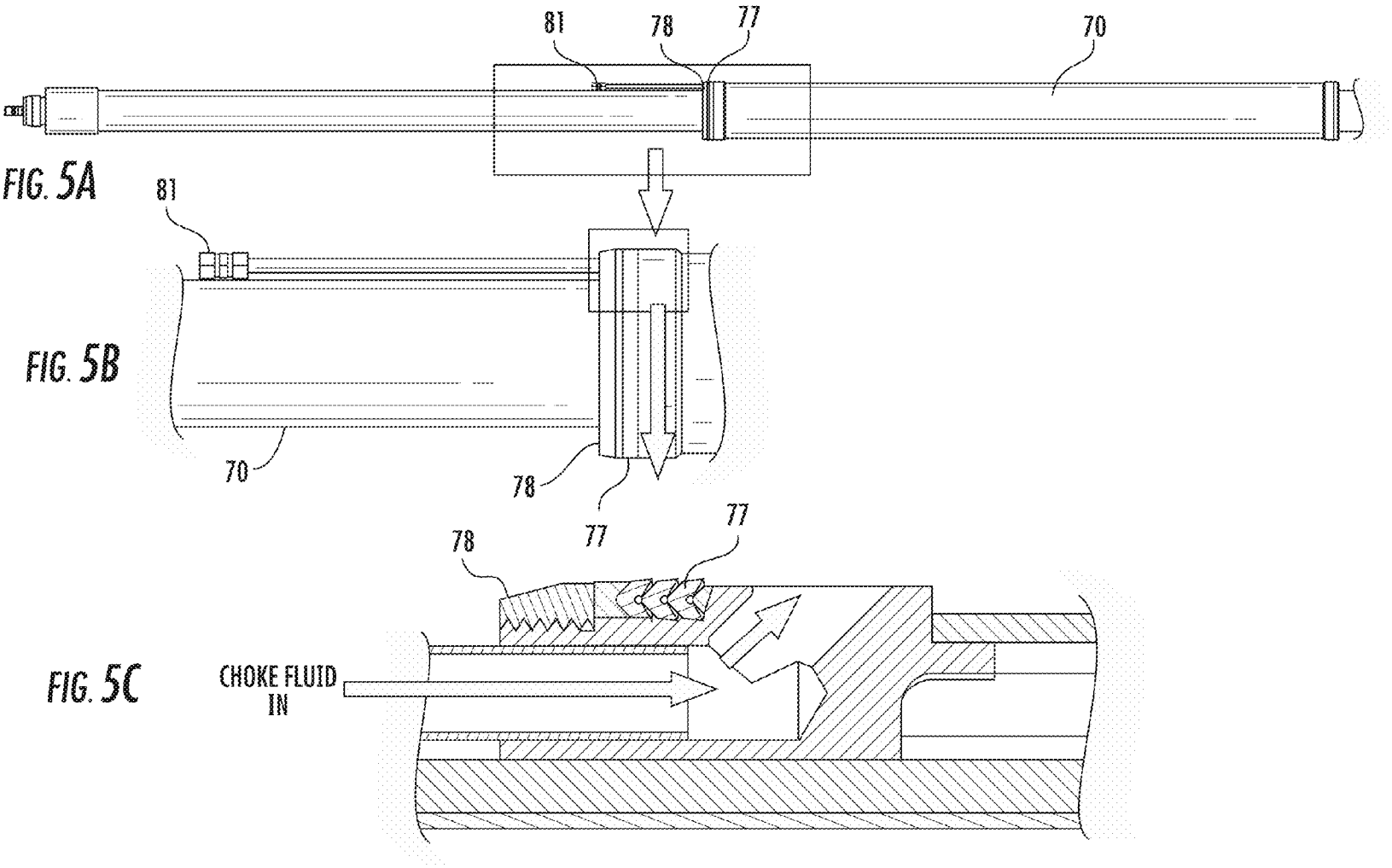
FIGS. 5(*a*)-5(*c*) are side and cross-sectional views of the choke fluid dispenser of the system of FIG. 1 illustrating example end attachment and sealing configurations thereof.

The choke fluid may enter the first annular chamber 72 via a connection tube 81, as seen in FIGS. 5(*b*) and 6. A relatively small diameter tube (e.g., ¾") may be used as the fluid line 61 to feed choke fluid from the choke fluid source 50 at the wellhead to the connection tube 81. The choke fluid dispenser may further include a respective seal 77 (e.g., a chevron seal(s)) and seal nut 78 at opposing ends of the inner sleeve 70, as seen in FIGS. 5(*a*)-(*c*). However, other suitable connection or sealing arrangements may be used in different embodiments, as will be appreciated by those skilled in the art. Thus, during operation of the example configuration, choke fluid is pumped into the system, it fills the first annular chamber 72 between the inner sleeve 70 and the liner 71 between the chevron seals 77, the fluid then moves through the screens 79 in the ports 73 and into the second annular chamber 75, and is jetted out into the formation 32 via the holes 76.

Choke fluid dispersion into the formation 32 may be controlled by leaving a desired spacing between the choke fluid dispenser 60 and any collection openings 80 used for collecting reservoir fluids, as noted above. This offset helps to define a desired effective area where choke fluid can permeate without being prematurely drawn back into the openings 80. This, in turn, helps to ensure that the choke fluid provides the desired choke functionality, before it is re-absorbed and "produced" with other reservoir fluids. An example choke fluid flow or dispensing rate may be between 0.1 and 10 gallons of continuous fluid flow per minute for a typical RF heating application, although other flow rates (and intermittent fluid flow) may be used in some applications. In a simulated example with a 1.4 gallon per minute flow, a total power dissipation for a 400 m antenna configuration was 400 kilowatts for an antenna power of 4 kilowatts per meter of antenna).

By way of comparison, a magnetic choke (such as described in the above-noted U.S. patent application Ser. No. 9,441,472) may in some implementations utilize a relatively large annular volume to function with desired impedance, which in turn may drive larger than standard drilling and liner sizes and increase drilling costs. The choke fluid dispenser 60 may be relatively compact in terms of length (e.g., it may be less than about 10 m in some applications), while remaining compatible with standard size pipe diameters. More particularly, drilling and completion costs typically vary with the square of the diameter, and thus keeping the diameters as small as possible may result in significant installation savings. Another potential benefit of the relatively compact size of the choke fluid dispenser 60 is that this may allow for sufficient envelope to package a transmission line 38 with enough flow area to allow the extension to longer or deeper implementation lengths.

Another contrast between the choke fluid dispenser 60 and a magnetic choke is that of efficiency, in that the choke fluid dispenser may provide for somewhat higher efficiency operation in terms of how much input RF energy is lost during operation of the antenna 35. The enhanced efficiency may also result in decreased operational costs, as will be appreciated by those skilled in the art. Moreover, magnetic chokes may generate significant heat and accordingly require cooling via a cooling fluid circulation system, for example, which is not the case with the choke fluid dispenser 60. The choke fluid dispenser 60 may not only provide broad band choke performance over desired operating frequency ranges similar to an magnetic choke, but it may also represent a savings in terms of the number and complexity of components, and thus a potential for additional cost savings. As a result, the choke fluid dispenser 60 may be particularly useful in "early" start-up wells used to enhance production flow at the beginning of the recovery process, while magnetic chokes may be more appropriate for longer term recovery wells where enhanced tenability features may be desired over time. However, either type of configuration may be used in relatively short or long-term wells, and in some instances both a magnetic choke assembly and a choke fluid dispenser may be used in the same well, if desired.

A related method for heating the hydrocarbon resource 31 in the subterranean formation 32 is also provided. The method may include applying RF power to the elongate RF antenna 35 positioned within the wellbore using the RF source 34. The method may further include selectively dispensing choke fluid from the choke fluid source 50 into adjacent portions of the subterranean formation 32 via the choke fluid dispenser 60 positioned in the wellbore at the proximal end of the RF antenna 35 to define a common mode current choke at the proximal end of the RF antenna, as discussed further above.

Figure 8:
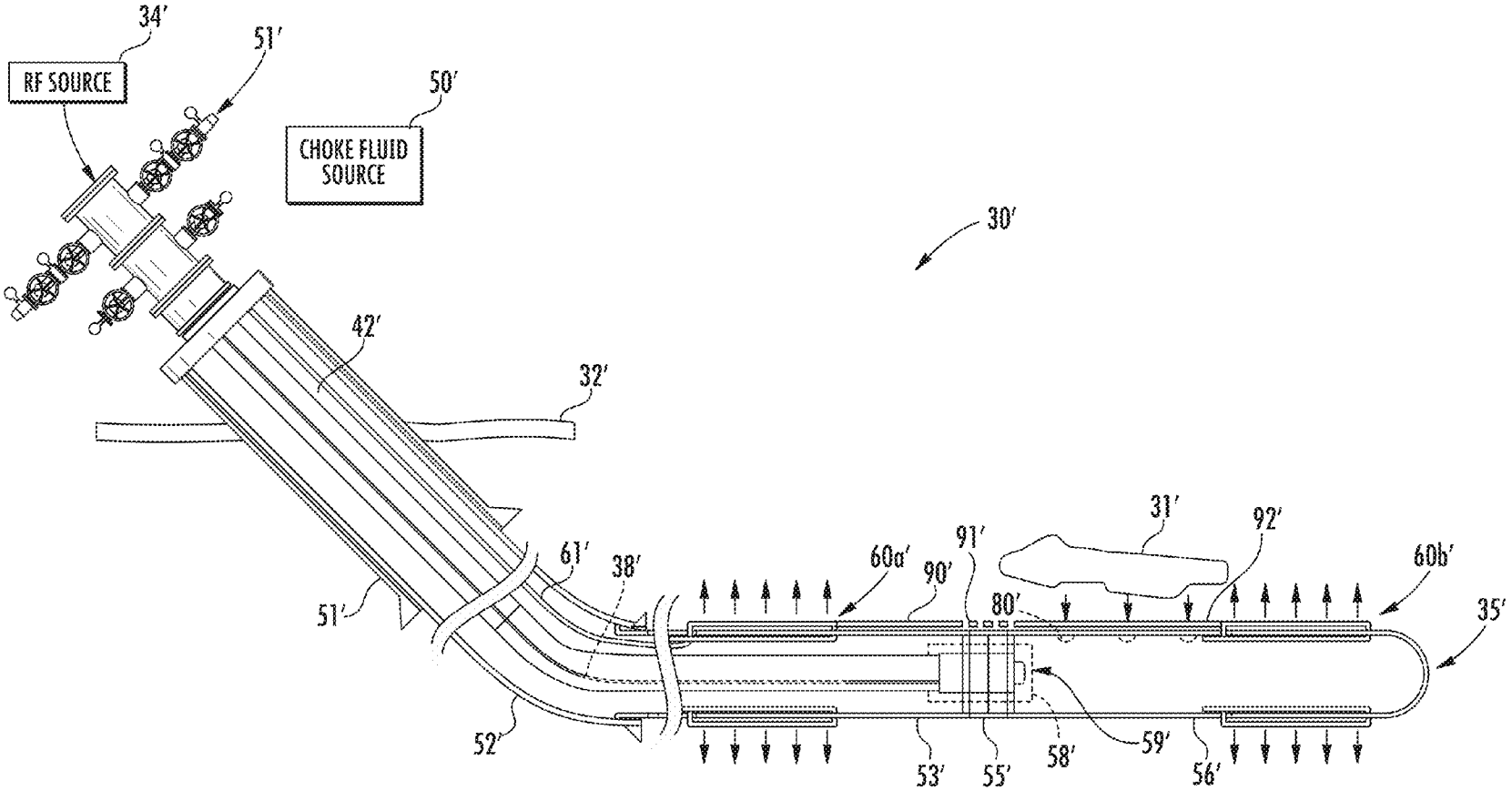
FIG. 8 is a schematic diagram, partially in section, of a system for heating a hydrocarbon resource in accordance with another example embodiment including multiple choke fluid dispensers.

Turning to FIG. 8, another embodiment of the system 30' is now described which illustratively includes a first choke fluid dispenser 60*a*' positioned at the proximal end (or heel) of the RF antenna 35', as described above, as well as a second choke fluid dispenser 60*b*' positioned at the distal end (or toe) of the RF antenna. The second choke fluid dispenser 60*b*' may include similar components to those described above with reference to the choke fluid dispenser 60, but here the second choke fluid dispenser is carried by the distal slotted liner portion 56' of the RF antenna 35' rather than the RF transmission line 38'. The first and second choke fluid dispensers 60*a*', 60*b*' may be interconnected by tubing to supply them both with choke fluid from the choke fluid source 50'. More particularly, the tubing may include a proximal tubing portion 90' coupled to the first choke fluid dispenser 60*a*', a distal tubing portion 92' coupled to the second choke fluid dispenser 60*b*', and a central tubing portion 91' extending through the isolator 55' and coupled between the proximal and distal tubing portions. By way of example, the proximal and distal tubing portions 90', 92' may be made of metal, and the central tubing portion 91' may be made of a dielectric so that the various tubing portions match the thermal coefficients of the surrounding structure.

It should be noted that in some embodiments the proximal tubing portion 90' need not be connected to the first choke fluid dispenser 60*a*', and may instead connect directly to the choke fluid supply line 61' (e.g., via a Y splitter), or may itself be another supply line extending to the choke fluid source 50'. In this way, a more even supply of choke fluid may be supplied to the first and second choke fluid dispensers 60*a*', 60*b*', or specific amounts of choke fluid may be dispensed to them in a desired proportion or ratio, if desired. Generally speaking, a flow rate of one to two gallons of choke fluid to each of the first and second choke fluid dispensers 60*a*', 60*b*' may be used in a typical embodiment, although different flow rates may be used for different implementations (and, again, different flow rates to the first and second choke fluid dispensers may also be used).

The use of two choke fluid dispensers 60*a*', 60*b*' advantageously helps to distribute the heat from the RF antenna 35' between the proximal and distal ends thereof, which accordingly help balance out the electric field. That is, in some implementations there by may be uneven heating from using a single choke fluid dispenser, although in different embodiments a single choke fluid dispenser may be located at the heel of the antenna as described above, or at the toe of the antenna. In some embodiments, the proximal and distal slotted liner portions 53', 56' of the antenna 35' may be made different lengths to also help balance out the heating and electric field.

A related method for heating a hydrocarbon resource 31' in a subterranean formation 32' having a wellbore extending therein may include applying RF power to an elongate RF antenna 35' positioned within the wellbore using an RF source 34', where the elongate RF antenna has a proximal end and a distal end separated from the proximal end. The method may further include selectively dispensing a choke fluid from a choke fluid source 50' into adjacent portions of the subterranean formation 32' at the proximal end of the RF antenna via a first choke fluid dispenser 60*a*' positioned in the wellbore at the proximal end of the RF antenna 35'. The method may also include selectively dispensing choke fluid from the choke fluid source 50' into adjacent portions of the subterranean formation 32' at the distal end of the RF antenna 35' via a second choke fluid dispenser 60*b*' positioned in the wellbore at the distal end of the RF antenna 35'.

Many modifications and other embodiments will come to the mind of one skilled in the art having the benefit of the teachings presented in the foregoing descriptions and the associated drawings. Therefore, it is understood that the disclosure is not to be limited to the specific embodiments disclosed, and that modifications and embodiments are intended to be included within the scope of the appended claims.

That which is claimed is:

1. A system for heating a hydrocarbon resource in a subterranean formation having a wellbore extending therein, the system comprising:

a radio frequency (RF) source;

a choke fluid source;

an elongate RF antenna configured to be positioned within the wellbore and coupled to said RF source, said elongate RF antenna having a proximal end and a distal end separated from the proximal end;

a first choke fluid dispenser coupled to said choke fluid source and positioned to selectively dispense choke fluid into adjacent portions of the subterranean formation at the proximal end of said RF antenna; and a second choke fluid dispenser coupled to said choke fluid source and positioned to selectively dispense choke fluid into adjacent portions of the subterranean formation at the distal end of said RF antenna.

2. The system of claim 1 wherein said RF antenna comprises a proximal cylindrical conductor; and further comprising an RF transmission line extending at least partially within said proximal cylindrical conductor and coupling said RF source to said RF antenna.

3. The system of claim 2 wherein said first choke fluid dispenser is carried by said transmission line and comprises:

an inner sleeve surrounding said RF transmission line;

a liner surrounding said inner sleeve and defining a first annular chamber therewith, said liner having a plurality of ports therein in fluid communication with said choke fluid source; and an outer sleeve surrounding said liner and defining a second annular chamber therewith to receive choke fluid from the plurality of ports, said outer sleeve having a plurality of openings therein to pass choke fluid from the annular chamber into the subterranean formation adjacent the proximal end of the antenna.

4. The system of claim 3 wherein said inner sleeve is slidably moveable with respect to said liner; and wherein said liner is fixed to said outer sleeve.

5. The system of claim 2 wherein said RF antenna further comprises a center isolator coupled to the proximal cylindrical conductor and a distal cylindrical conductor coupled to the center isolator opposite the proximal cylindrical conductor; and wherein the second choke fluid dispenser is carried by said distal cylindrical conductor and comprises:

an inner sleeve;

a liner surrounding said inner sleeve and defining a first annular chamber therewith, said liner having a plurality of ports therein in fluid communication with said choke fluid source; and an outer sleeve surrounding said liner and defining a second annular chamber therewith to receive choke fluid from the plurality of ports, said outer sleeve having a plurality of openings therein to pass choke fluid from the annular chamber into the subterranean formation adjacent the distal end of the RF antenna.

6. The system of claim 1 wherein said first and second choke fluid dispensers each further comprises a respective seal at each opposing end.

7. The system of claim 1 wherein said RF antenna comprises a proximal cylindrical conductor having a plurality of collection openings therein to collect hydrocarbon resources from adjacent portions of the subterranean formation; and wherein said first choke fluid dispenser is positioned in spaced relation from the collection openings.

8. The system of claim 1 wherein the choke fluid comprises an electrical conductivity enhancing fluid.

9. The system of claim 1 wherein the choke fluid comprises water.

10. A system for heating a hydrocarbon resource in a subterranean formation having a wellbore extending therein, the system comprising:

an elongate RF antenna configured to be positioned within the wellbore and coupled to an RF source, said elongate RF antenna having a proximal end and a distal end separated from the proximal end;

a first choke fluid dispenser coupled to a choke fluid source and positioned to selectively dispense choke fluid into adjacent portions of the subterranean formation at the proximal end of said RF antenna; and a second choke fluid dispenser coupled to the choke fluid source and positioned to selectively dispense choke fluid into adjacent portions of the subterranean formation at the distal end of said RF antenna.

11. The system of claim 10 wherein said RF antenna comprises a proximal cylindrical conductor; and further comprising an RF transmission line extending at least partially within said proximal cylindrical conductor and coupling said RF source to said RF antenna.

12. The system of claim 11 wherein said first choke fluid dispenser is carried by said transmission line and comprises:

an inner sleeve surrounding said RF transmission line;

a liner surrounding said inner sleeve and defining a first annular chamber therewith, said liner having a plurality of ports therein in fluid communication with said choke fluid source; and an outer sleeve surrounding said liner and defining a second annular chamber therewith to receive choke fluid from the plurality of ports, said outer sleeve having a plurality of openings therein to pass choke fluid from the annular chamber into the subterranean formation adjacent the proximal end of the antenna.

13. The system of claim 12 wherein said inner sleeve is slidably moveable with respect to said liner; and wherein said liner is fixed to said outer sleeve.

14. The system of claim 11 wherein said RF antenna further comprises a center isolator coupled to the proximal cylindrical conductor and a distal cylindrical conductor coupled to the center isolator opposite the proximal cylindrical conductor; and wherein the second choke fluid dispenser is carried by said distal cylindrical conductor and comprises:

an inner sleeve;

a liner surrounding said inner sleeve and defining a first annular chamber therewith, said liner having a plurality of ports therein in fluid communication with said choke fluid source; and an outer sleeve surrounding said liner and defining a second annular chamber therewith to receive choke fluid from the plurality of ports, said outer sleeve having a plurality of openings therein to pass choke fluid from the annular chamber into the subterranean formation adjacent the distal end of the RF antenna.

15. The system of claim 10 wherein said first and second choke fluid dispensers each further comprises a respective seal at each opposing end.

16. The system of claim 10 wherein said RF antenna comprises a proximal cylindrical conductor having a plurality of collection openings therein to collect hydrocarbon resources from adjacent portions of the subterranean formation; and wherein said first choke fluid dispenser is positioned in spaced relation from the collection openings.

17. A method for heating a hydrocarbon resource in a subterranean formation having a wellbore extending therein, the method comprising:

applying RF power to an elongate RF antenna positioned within the wellbore using an RF source, the elongate RF antenna having a proximal end and a distal end separated from the proximal end; and selectively dispensing a choke fluid from a choke fluid source into adjacent portions of the subterranean formation at the proximal end of the RF antenna via a first choke fluid dispenser positioned in the wellbore at the proximal end of the RF antenna; and selectively dispensing choke fluid from the choke fluid source into adjacent portions of the subterranean formation at the distal end of the RF antenna via a second choke fluid dispenser positioned in the wellbore at the distal end of the RF antenna.

18. The method of claim 17 wherein the RF antenna comprises a proximal cylindrical conductor, and wherein an RF transmission line extends at least partially within the proximal cylindrical conductor and couples the RF source to the RF antenna.

19. The method of claim 18 wherein the first choke fluid dispenser is carried by the transmission line and comprises:

an inner sleeve surrounding the RF transmission line;

a liner surrounding the inner sleeve and defining a first annular chamber therewith, the liner having a plurality of ports therein in fluid communication with the choke fluid source; and an outer sleeve surrounding the liner and defining a second annular chamber therewith to receive choke fluid from the plurality of ports, the outer sleeve having a plurality of openings therein to pass choke fluid from the annular chamber into the subterranean formation adjacent the proximal end of the antenna.

20. The method of claim 18 wherein the RF antenna further comprises a center isolator coupled to the proximal cylindrical conductor and a distal cylindrical conductor coupled to the center isolator opposite the proximal cylindrical conductor; and wherein the second choke fluid dispenser is carried by the distal cylindrical conductor and comprises:

an inner sleeve;

a liner surrounding the inner sleeve and defining a first annular chamber therewith, the liner having a plurality of ports therein in fluid communication with the choke fluid source; and an outer sleeve surrounding the liner and defining a second annular chamber therewith to receive choke fluid from the plurality of ports, the outer sleeve having a plurality of openings therein to pass choke fluid from the annular chamber into the subterranean formation adjacent the distal end of the RF antenna.

* * * * *